US006729629B2

(12) United States Patent
Chi

(10) Patent No.: US 6,729,629 B2
(45) Date of Patent: May 4, 2004

(54) MECHANISM FOR DETACHABLY FASTENING BOOT AND TRUCK OF ROLLER SKATE

(75) Inventor: Owen Chi, Taipei Hsien (TW)

(73) Assignee: Wever Co., Ltd., Taipei (TW)

( * ) Notice: Subject to any disclaimer, the term of this patent is extended or adjusted under 35 U.S.C. 154(b) by 45 days.

(21) Appl. No.: 10/134,371

(22) Filed: Apr. 30, 2002

(65) Prior Publication Data

US 2003/0201614 A1 Oct. 30, 2003

(51) Int. Cl.[7] ..... A63C 17/02

(52) U.S. Cl. ..... 280/11.27; 280/11.33; 280/811

(58) Field of Search ..... 280/11.19, 11.27, 280/11.28, 11.3, 634, 636, 11.207, 7.1, 11.31, 11.32, 11.33, 11.12, 11.224, 7.12, 7.13, 7.14, 618, 809, 811; 36/115, 58.5, 58.6

(56) References Cited

U.S. PATENT DOCUMENTS 2,244,719 A * 6/1941 Mansfield ..... 280/11.3
2,998,260 A * 8/1961 Meyer ..... 280/7.13
3,918,729 A * 11/1975 Peters ..... 280/11.3
4,298,210 A * 11/1981 Lotteau et al. ..... 280/259
5,852,955 A * 12/1998 Crisick et al. ..... 74/594.6
6,120,038 A * 9/2000 Dong et al. ..... 280/7.13
6,270,089 B1 * 8/2001 Marechal ..... 280/11.3
6,331,007 B1 * 12/2001 Bryce ..... 280/11.3
6,334,621 B1 * 1/2002 Chang ..... 280/11.3
6,382,638 B1 * 5/2002 Lee ..... 280/7.13
6,499,757 B1 * 12/2002 Berger et al. ..... 280/607
6,572,121 B2 * 6/2003 Shih ..... 280/11.33

* cited by examiner

*Primary Examiner*—Brian Johnson
*Assistant Examiner*—Brian Swenson
(74) *Attorney, Agent, or Firm*—Bacon & Thomas, PLLC

(57) ABSTRACT

A detachable roller skate comprises a boot comprising a front cavity, a rear cavity, and an elongate plate interconnected the cavities wherein each cavity has two resilient side protrusions and a rear projection; and a truck comprising a sole plate, an engagement plate threadedly secured to sole plate, a front abutment member on top of engagement plate having a neck and a rear projected member above neck, a rear opening in engagement plate, a front upright projection in rear opening, an internal spring receptacle, a channel extended from rear opening to a rear end of engagement plate, and a push block comprising a front flat, a rear elongated plate, a stop member above flat, two side grooves at stop member, an abutted member on top of stop member, and two side dents at abutted member being perpendicular to and in communication with side grooves. The invention can easily fasten boot and truck or unfasten the same.

5 Claims, 8 Drawing Sheets

MECHANISM FOR DETACHABLY FASTENING BOOT AND TRUCK OF ROLLER SKATE

FIELD OF THE INVENTION

The present invention relates to roller skate and more particularly to an improved mechanism for easily fastening boot and truck of a detachable roller skate or unfastening the same.

BACKGROUND OF THE INVENTION

Roller skates have been popular for a long time. One type of commercially available roller skate discloses a frame and two pairs of small wheels fixedly attached to frame. Frame comprises a front arcuate wall, a rear arcuate wall, and a strap. In use, first user wears a pair of sports shoes. Next, place each shoe between front and rear walls of frame. Finally, fasten strap to secure each shoe to roller skate.

However, the prior art suffered from several disadvantages. For example, the wearing process is time consuming and tedious, thus bringing inconvenience to user. The unfastening process also has above drawbacks. The drawbacks of the prior art are especially undesirable if a frequent wearing and taking-off (for example, going to bathroom temporarily) occurs. Further, a fastening of shoe and roller skate is not reliable because a total fit therebetween is generally not obtainable. Furthermore, the fastening of shoe and roller skate is provided mainly by strap and urged forces between toe portion of shoe and front wall and between heel portion of shoe and rear wall. As to contact area between sole of shoe and roller skate, it is less than the area of sole. In other words, there are gaps between the sole and roller skate. Hence, wearer of roller skate may feel uncomfortable while gliding.

Another type of roller skate comprises a boot and a frame having wheels wherein the frame is threadedly or fixedly secured to boot. In use, users first wears a pair of socks. Next, put on the roller skate directly. Finally, fasten the roller skate by strap or buckle arrangement. It is an improvement of the first prior art. But this is still unsatisfactory for the purpose for which the invention is concerned for the following reasons: First, an unfastening process is tedious. This is particularly true if a frequent wearing and taking-off (for example, going to bathroom temporarily) occurs. Further, a degree of comfort while wearing the roller skate is not satisfactorily acceptable due to rigidness of the boot. To the worse, legs of user are susceptible to hurt if wears such roller skate for gliding. Thus improvement exists.

SUMMARY OF THE INVENTION

It is therefore an object of the present invention to provide a detachable roller skate comprising a boot comprising an elongate plate on a sole, a front rounded cavity at a front end of the elongate plate, and a rear rounded cavity at a rear end of the elongate plate wherein each cavity has two resilient side protrusions and a rear projection; a wheeled truck comprising a sole plate, an engagement plate sized to be substantially the same as the sole plate and being threadedly secured to the sole plate, a front abutment member on a top of the engagement plate having a neck and a rear projected member above the neck, a rear opening in the engagement plate, a front upright projection in the rear opening, an internal receptacle extended forward from about a bottom of the upright projection, a resilient member received in the receptacle, and a channel extended from the rear opening to a rear end of the engagement plate; and a push block comprising a front flat, a rear elongated plate, a stop member above the flat, two side grooves at the stop member, an abutted member on a top of the stop member, and two side dents at the abutted member being perpendicular to and in communication with the side grooves; wherein in an assembly process insert the flat into the rear opening until the stop member passes through the front end of the flat to be urged by the resilient member in the receptacle, the rear elongated plate is received in the channel with its rear end extended beyond the rear end of the engagement plate due to an expansion of the resilient member, align the front cavity with the front abutment member prior to engagement with the side protrusions of the front cavity clung in the neck and the rear projection of the front cavity fastened to the projected member, press down a heel portion of the boot to cling the rear cavity onto the stop member and the side protrusions and the rear projection of the rear cavity engaged with the abutted member and the side dents respectively, bias the resilient member forward, in response to the side protrusions of the rear cavity passing through the side dents, and the push block is pushed upward by a rearward expansion of the resilient member to urge the side protrusions and the rear projection of the rear cavity against sides and a rear end of the abutted member respectively; or in a disassembly process, push the rear elongated plate forward to disengage the stop member from the rear cavity, in response, lift the heel portion of the boot and pull the same rearward, and detach the boot from the roller skate. With this roller skate, it is possible of easily fastening boot, truck, and push block together or unfastening the same.

The above and other objects, features and advantages of the present invention will become apparent from the following detailed description taken with the accompanying drawings.

DETAILED DESCRIPTION OF THE PREFERRED EMBODIMENTS

Figure 1:
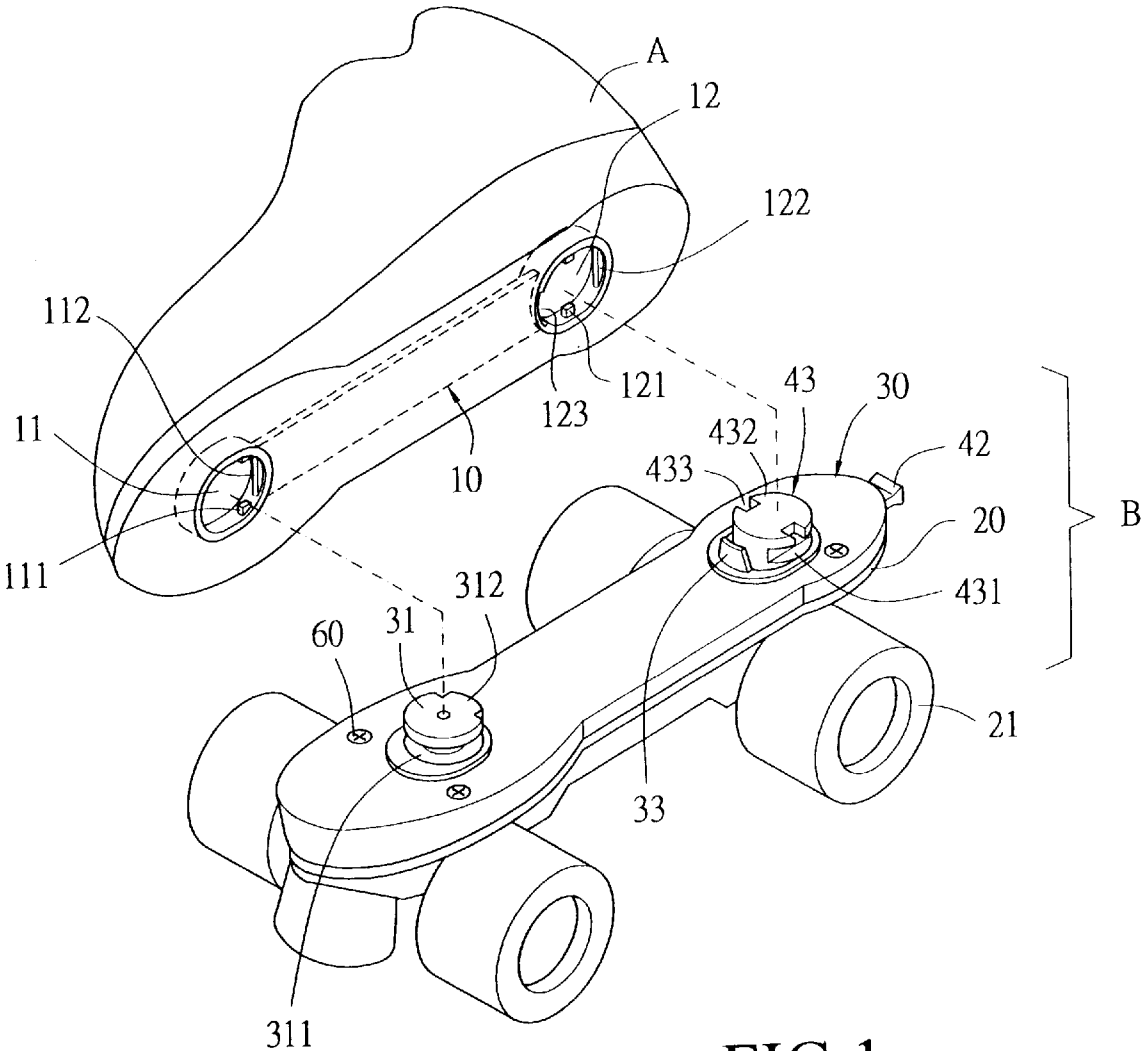
FIG. 1 is an exploded view of a preferred embodiment of fastening mechanism for roller skate according to the invention.
Figure 2:
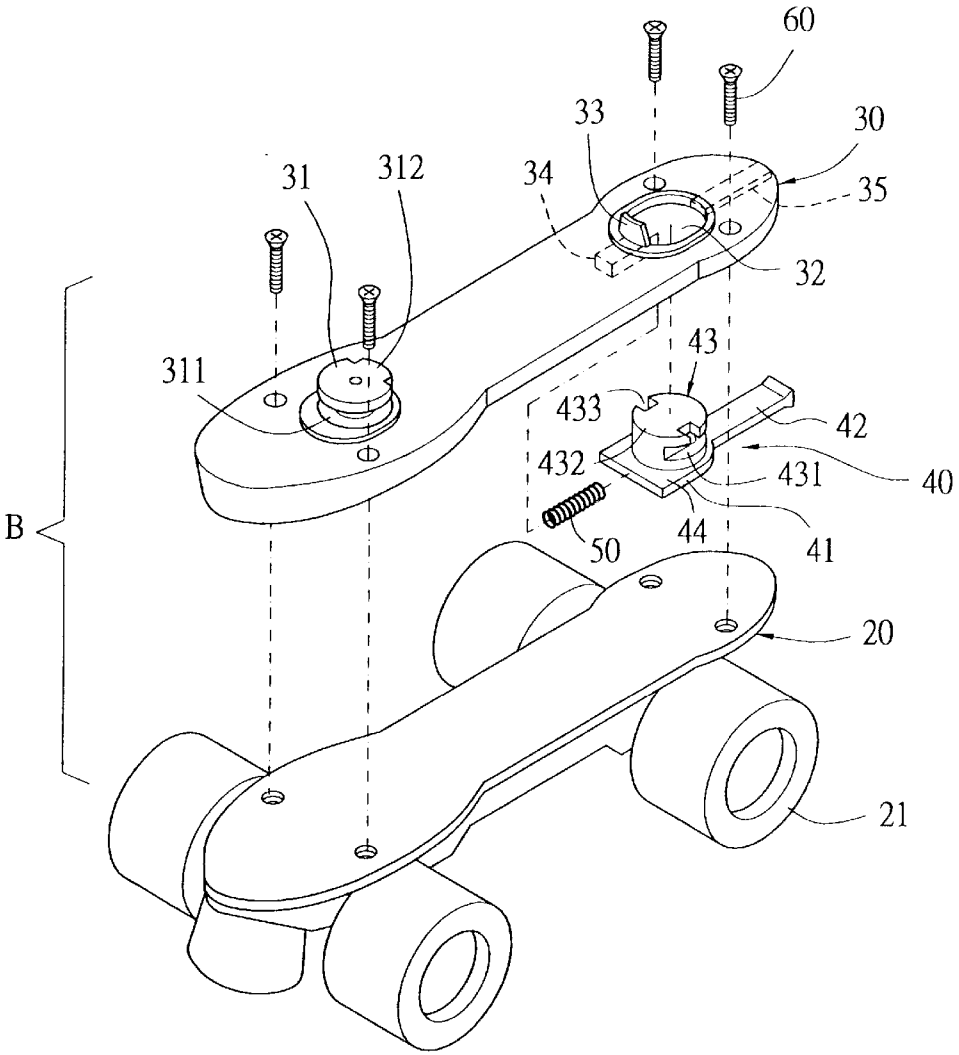
FIG. 2 is an exploded view of heel portion of FIG. 1.
Figure 5:
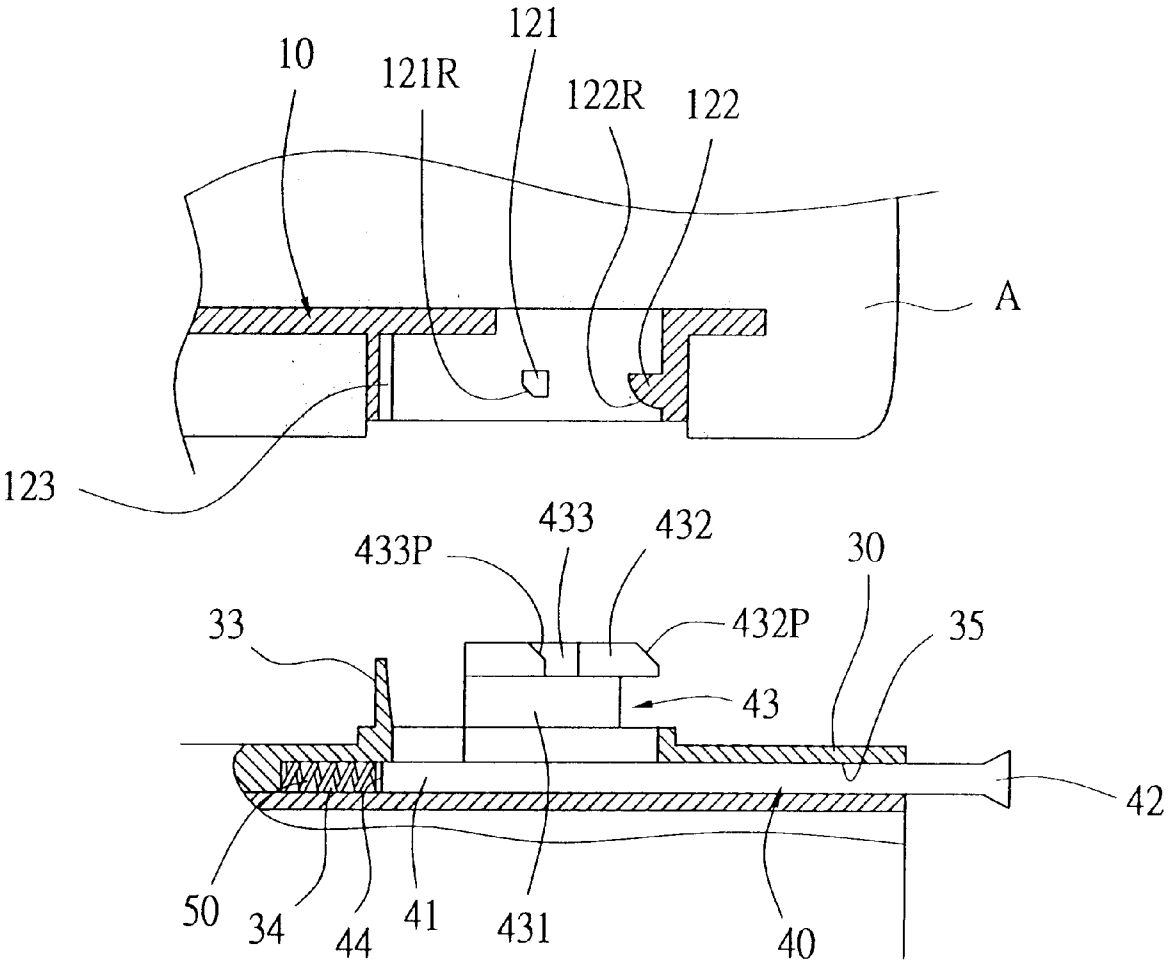
FIGS. 5, 6, and 7 are cross-sectional views illustrating the fastening of heel portion of the roller skate respectively.

Referring to FIGS. 1, 2 and 5, there is shown a fastening mechanism for roller skate in accordance with the invention. The roller skate consists of a boot A and a truck B. Boot A comprises an elongate plate 10 on the sole, a front rounded cavity 11 at a front end of elongate plate 10, and a rear rounded cavity 12 at a rear end of elongate plate 10, both cavities 11 and 12 having downward openings. In cavities 11 and 12, there are provided resilient side protrusions 111 and 121 and rear projections 112 and 122. In a front side of rear cavity 12, an upward auxiliary slot 123 is provided. Also, in rear cavity 12 there are provided arcuate surfaces 121R and 122R on lower front sides of side protrusions 121 and rear projection 122 respectively. The provision of arcuate surfaces 121R and 122R are for facilitating engagement.

Truck B comprises two pairs of smaller wheels 21 near the toe and the heel respectively; a sole plate 20, an engagement plate 30 sized to be substantially the same as sole plate 20, a plurality of screws 60 for threadedly securing engagement plate 30 to sole plate 20, a front abutment member 31 on top of engagement plate 30 having a neck 311 and a rear projected member 312 above the neck 311, a rear opening 32 in engagement plate 30, a front upright projection 33 in rear opening 32, an internal receptacle 34 extended forward from about the bottom of the upright projection 33, a helical spring 50 received in the receptacle 34, and a channel 50 extended from rear opening 32 to the rear end of engagement plate 30.

A push block 40 comprises a flat 41 in the front, rear portion of the flat 41 being arcuate for mating with rear opening 32 of engagement plate 30 while front end 44 thereof being straight, an elongate plate 42 in the rear, a stop member 43 above the flat 41, two side grooves 431 at the stop member 43, an abutment member 432 on top of stop member 43, two side dents 433 at abutment member 432 being perpendicular to and in communication with side grooves 431, and oblique surfaces 432P and 433P on rear of abutment member 432 and on fronts of side dents 433 respectively. The provision of oblique surfaces 432P and 433P are for facilitating engagement.

Figure 3:
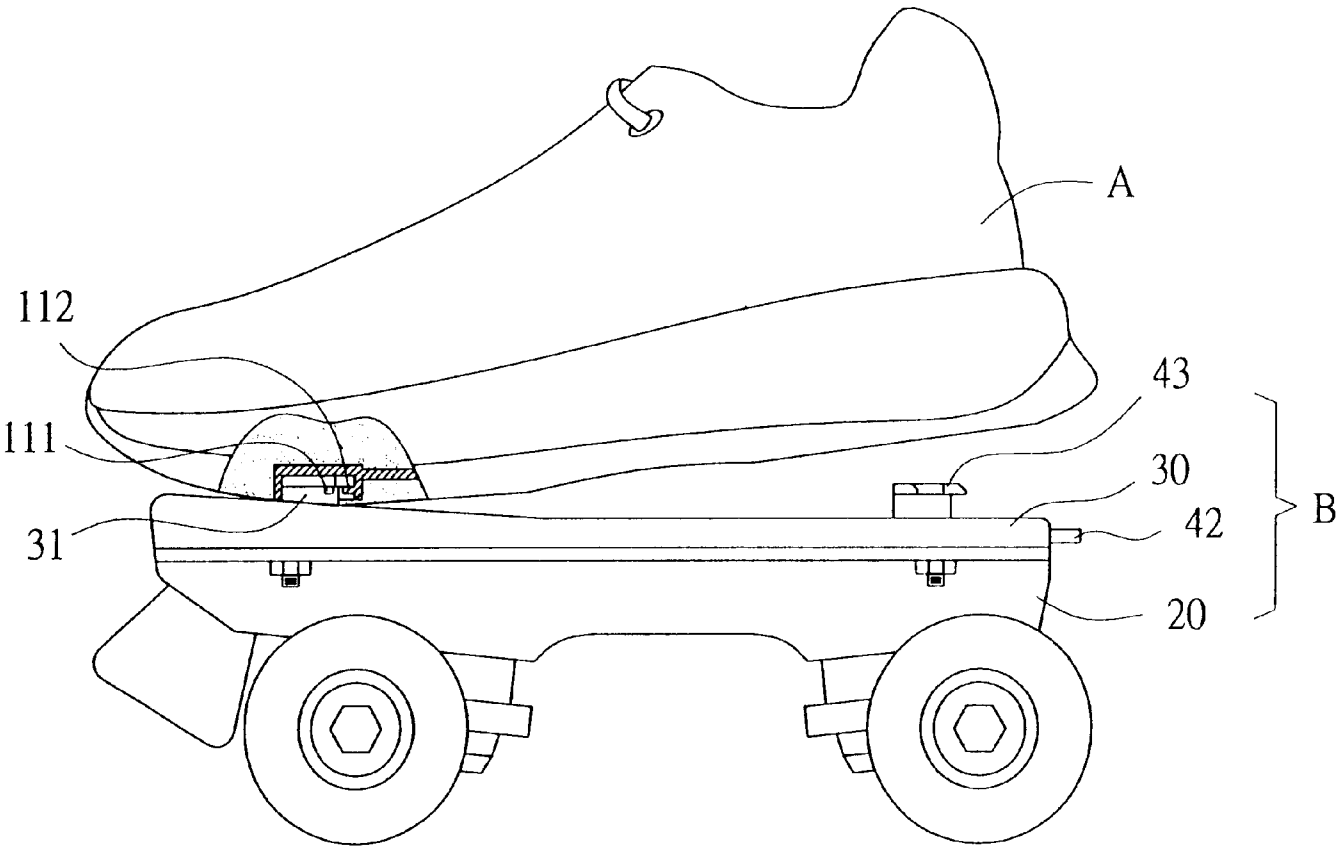
FIG. 3 is a side view in part section illustrating a fastening of toe portion of the roller skate.
Figure 4:
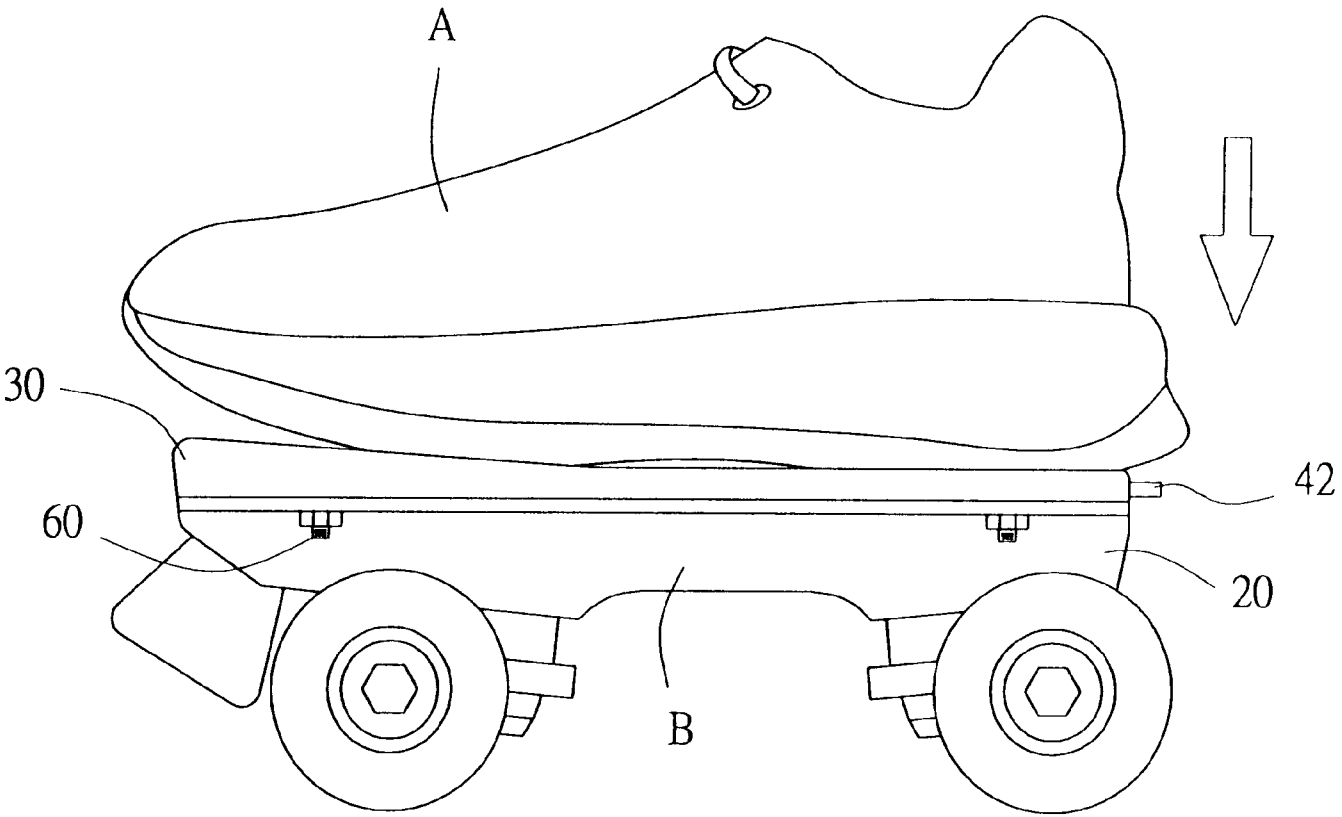
FIG. 4 is a side view illustrating the fastened toe portion and heel portion of the roller skate.
Figure 6:
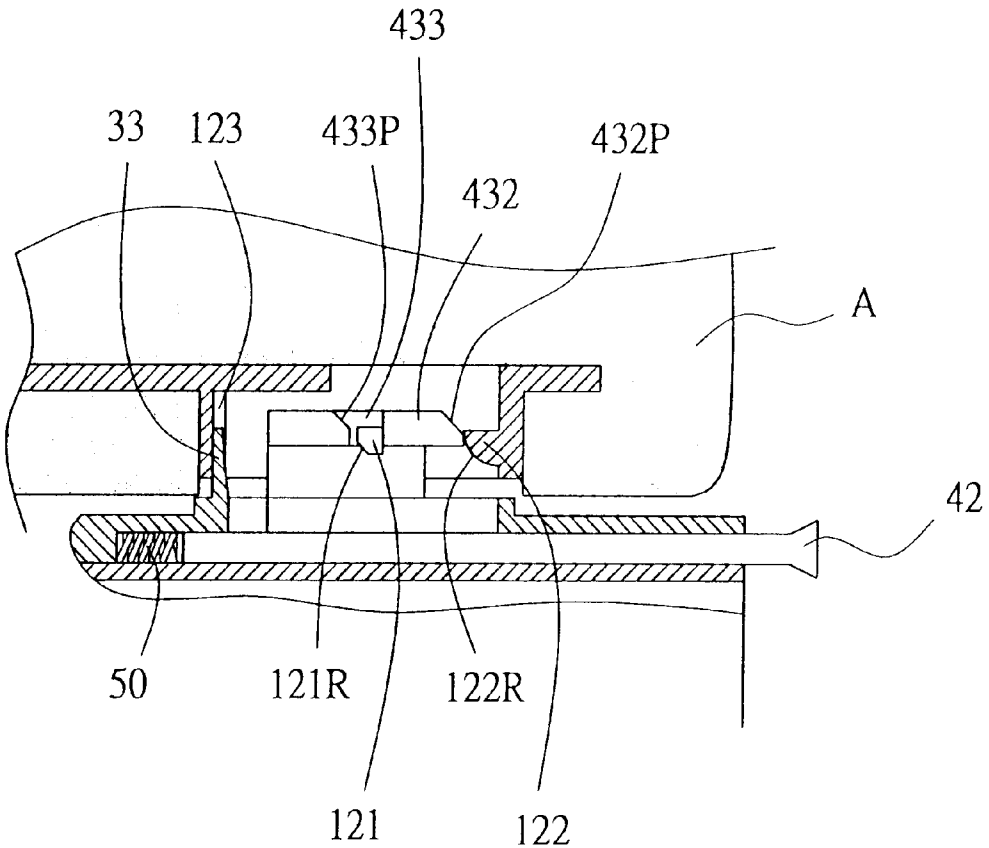
Figure 7:
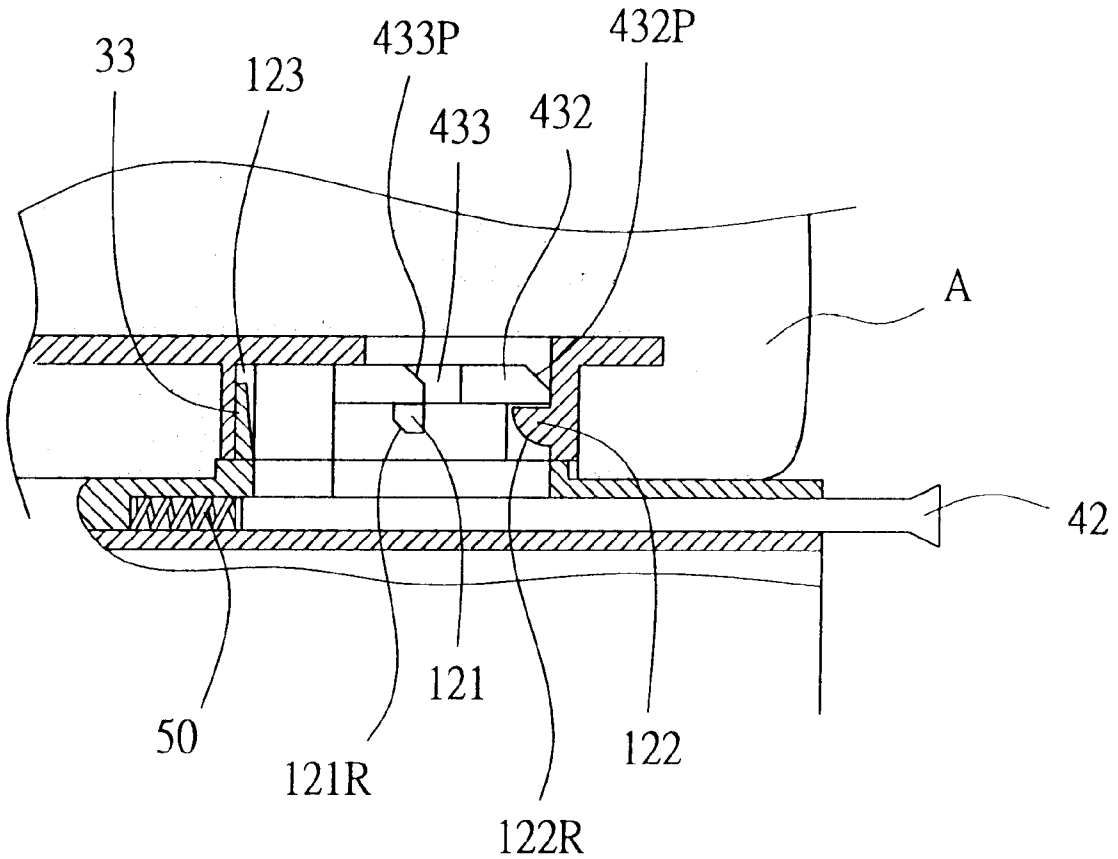
Figure 8:
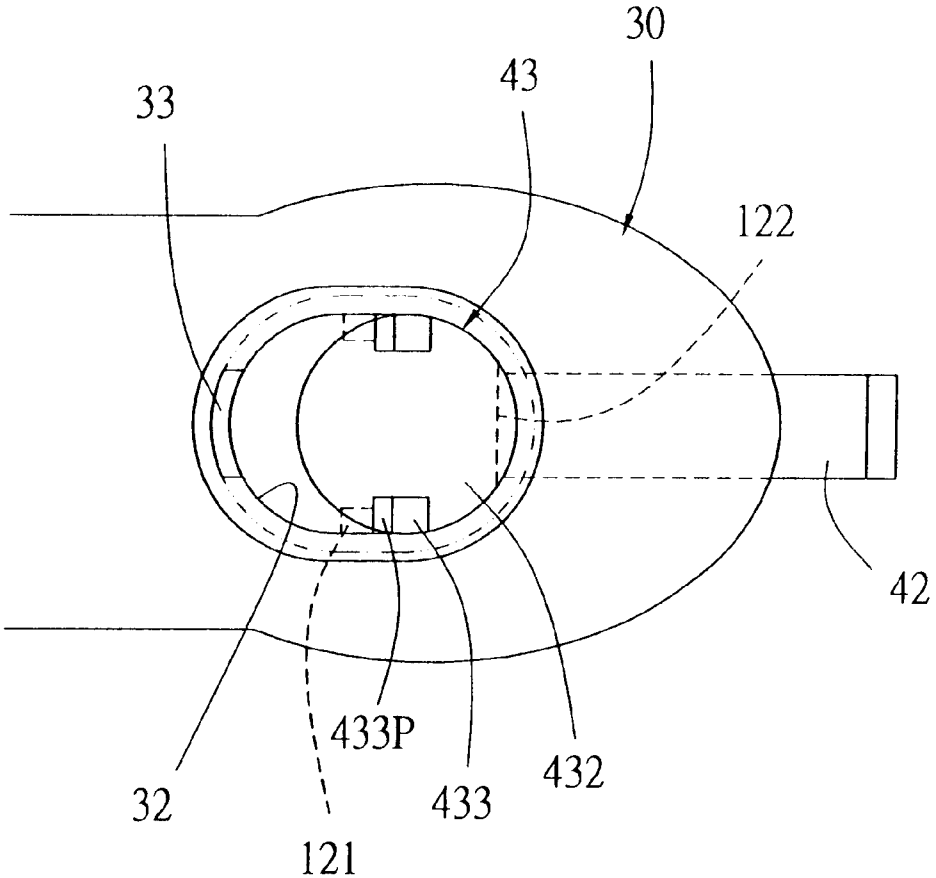
FIG. 8 is a top plan view showing details of fastening mechanism in heel portion of the roller skate.

Referring to FIGS. 3, 4, 5, 6, 7 and 8 in conjunction with FIGS. 1 and 2, the fastening process will now be described in detail below. First insert flat 41 of push block 40 into rear opening 32 until stop member 43 passes through front end 44 to be urged by spring 50 in receptacle 34. The rear elongate plate 42 is received in channel 50 with its rear end extended beyond the rear end of engagement plate 30 due to the expansion of spring 50. Also, spring 35 is prevented from disengaging from receptacle 34 due to the securing of engagement plate 30 and sole plate 20. Next, align the front cavity 11 of boot A with the front abutment member 31 prior to engagement wherein side protrusions 111 are clung in neck 311 and projection 112 is fastened to projected member 312 (FIG. 3). Next, as shown in FIG. 4, press down heel portion of boot A to cling rear cavity 12 onto the stop member 43 wherein the front upright projection 33 is inserted into auxiliary slot 123 to fasten therein. At this position, as shown in FIG. 5, arcuate surfaces 121R and 122R on lower front sides of side protrusions 121 and rear projection 122 are aligned with oblique surfaces 432P and 433P on rear of abutment member 432 and on fronts of side dents 433 respectively. Thereafter, it is possible of engaging them together. At this time, as shown in FIG. 6, spring 50 is biased forward. Next, as shown FIGS. 7 and 8, after side protrusions 121 have passed through side dents 433, push block 40 is pushed upward by a rearward expansion of spring 50 to cause side protrusions 121 and rear projection 122 to urge against sides and rear end of abutment member 432 respectively. To the contrary, in a process of removing boot A from roller skate, first push the rear elongate plate 42 of push block 40 forward to disengage stop member 43 from rear cavity 12. Next, lift heel portion of boot A and pull the same rearward. Finally, boot A is detached from roller skate.

In brief, the invention has the following advantages: First, its assembly process is simple and fast while maintaining a secure fastening of boot to roller skate. Second, the contact area between sole of boot and roller skate is substantially the same as the area of boot sole. In other words, there is very little gap between the boot sole and roller skate. Hence, wearer of roller skate may feel comfortable while gliding. Third, its disassembly process is also simple. Thus, wearer of roller skate may take off the boot in a few seconds prior to walking by the boot.

While the invention has been described by means of specific embodiments, numerous modifications and variations could be made thereto by those skilled in the art without departing from the scope and spirit of the invention set forth in the claims.

What is claimed is:

1. A detachable roller skate comprising:

a boot comprising an elongated plate on a sole, a front rounded cavity at a front end of the elongated plate, and a rear rounded cavity at a rear end of the elongate plate wherein each cavity has two resilient side protrusions and a rear projection;

a truck comprising a sole plate, an engagement plate sized to be substantially the same as the sole plate and being threadedly secured to the sole plate, a front abutment member on a top of the engagement plate having a neck and a rear projected member above the neck, a rear opening in the engagement plate, a front upright projection in the rear opening, an internal receptacle extended forward from about a bottom of the upright projection, a resilient member received in the receptacle, and a channel extended from the rear opening to a rear end of the engagement plate; and a push block comprising a front flat, a rear elongated plate, a stop member above the flat, two side grooves at the stop member, an abutted member on a top of the stop member, and two side dents at the abutted member being perpendicular to and in communication with the side grooves;

wherein the flat is sized to be inserted into the rear opening, the stop member is sized to pass through the front end of the flat biased by the resilient member in the receptacle, the rear elongated plate is adapted to be received in the channel with its rear end extended beyond the rear end of the engagement plate due to an expansion of the resilient member, the front cavity is adapted to be aligned with the front abutment member the rear cavity is adapted to be attached to the stop member by downward pressure of the heel of the boot and the side protrusions and the rear projection of the rear cavity, are adapted to engage with the abutted member and the side dents respectively, biasing the resilient member forward, the push block is adapted to be received upward by a rearward expansion of the resilient member to urge the side protrusions and the rear projection of the rear cavity against sides and a rear end of the abutted member respectively; and wherein the rear elongated plate is adapted to be located forward to disengage the stop member from the rear cavity to disengage the heel portion of the boot from the roller skate by locating the heel upward and rearward from the rear cavity.

2. The detachable roller skate of claim 1, wherein the front flat has an arcuate rear portion for mating with the rear opening of the engagement plate and a straight front end for urging against the resilient member.

3. The detachable roller skate of claim 1, further comprising arcuate surfaces on lower front sides of the side protrusions and the rear projection of the rear cavity respectively and oblique surfaces on the rear end of the abutted member and on front ends of the side dents respectively for facilitating an engagement of the side protrusions and the rear projection of the rear cavity against the sides and the rear end of the abutted member respectively.

4. The detachable roller skate of claim 1, wherein the truck further comprises a front upright projection in the rear opening and the rear cavity further comprises a front upward auxiliary slot for fastening the front upright projection therein.

5. The detachable roller skate of claim 1, wherein the resilient member is a helical spring.

* * * * *